US005366184A

United States Patent [19]

Testart et al.

[11] Patent Number: 5,366,184

[45] Date of Patent: Nov. 22, 1994

[54] SEAT FOR THE MOVABLE POINT IN A CRADLE OF A CROSSING FROG INCORPORATED IN LONG WELDED RAILS AND PROCESS FOR THE PRODUCTION OF SUCH A SEAT

[75] Inventors: Gerard Testart; Frederic Hege, both of Strasbourg, France

[73] Assignee: Cogifer-Compagnie Generale d'Installations Ferroviaires, Croissy sur Seine, France

[21] Appl. No.: 115,424

[22] Filed: Sep. 2, 1993

[30] Foreign Application Priority Data

Sep. 11, 1992 [FR] France ..... 92 11016

[51] Int. Cl.[5] ..... E01B 7/00

[52] U.S. Cl. ..... 246/385; 246/377; 246/415 R; 246/418; 246/438; 246/442; 238/165

[58] Field of Search ..... 246/376, 377, 385, 415 R, 246/416, 417, 418, 435 R, 438, 442, 445, 453, 463, 464; 238/165, 251, 260, 262

[56] References Cited

U.S. PATENT DOCUMENTS

| | | | |
|---|---|---|---|
| 660,000 | 10/1900 | Bryant | 238/165 |
| 1,721,460 | 7/1929 | Mariman | 246/435 R |
| 2,405,407 | 8/1946 | Conley | 246/471 |
| 4,953,814 | 9/1990 | Oswald et al. | 246/385 X |
| 5,133,522 | 7/1992 | Testart | 246/453 X |
| 5,207,401 | 5/1993 | Testart | 246/442 |

FOREIGN PATENT DOCUMENTS

| | | | |
|---|---|---|---|
| 542569 | 11/1955 | Belgium . | |
| 0282796 | 9/1988 | European Pat. Off. . | |
| 0298950 | 1/1989 | European Pat. Off. . | |
| 946066 | 7/1956 | Germany . | |
| 402913 | 5/1966 | Switzerland . | |
| 3715 | of 1892 | United Kingdom | 246/415 |

*Primary Examiner*—Robert J. Oberleitner
*Assistant Examiner*—S. Joseph Morano
*Attorney, Agent, or Firm*—Young & Thompson

[57] ABSTRACT

The present invention relates to a seat for the movable point in a cradle of a crossing frog incorporated in long welded rails and the process for production of such a seat. The seat is characterized in that the connection between the movable point (1) and the element (2″) of the cradle constituted by two rails (3 and 4) is effected by an essentially mechanical assembly. The invention is more particularly applicable to the field of the construction of railway equipment, particularly, crossing frogs.

5 Claims, 3 Drawing Sheets

SEAT FOR THE MOVABLE POINT IN A CRADLE OF A CROSSING FROG INCORPORATED IN LONG WELDED RAILS AND PROCESS FOR THE PRODUCTION OF SUCH A SEAT

The present invention relates to the field of the construction of railway equipment, particularly crossing frogs, and has for its object a seat for the movable point in the cradle of a crossing frog incorporated in long welded rails.

The invention also has for its object a process for the production of such a seat.

Such a cradle is generally constituted by a monoblock element, preferably of manganese steel, and by an element formed by the rails joined at the monoblock portion by welding, or by any other form of assembly, said element being rigidified by plates applied from below.

The seat of the movable point in the cradle is particularly important in an apparatus incorporated in long welded rails, because they are subjected to vertical forces due to the passage of the vehicles and by tractive or compressive forces due to variations of temperature in the long welded rails.

The present invention has for its object to provide an essentially mechanical connection between the movable point and the cradle.

It thus has for its object a seat for the movable point in the cradle of a crossing frog incorporated in long welded rails, said cradle being composed of two elements, namely, a monoblock element and an element constituted by two rails and connected to the monoblock element by welding or by any other form of assembly, characterized in that the connection between the movable point and the cradle element constituted by two rails is effected by an essentially mechanical assembly.

The invention also has for its object the process for the production of the seat, characterized in that it comprises a provisional phase of mounting the different elements of the movable point and of the cradle of the crossing frog, and a final phase of the emplacement of disassemblable mechanical connection means.

The invention will be better understood from the following description, which relates to a preferred embodiment, given by way of non-limiting example, and explained with reference to the accompanying schematic drawings, in which.

According to the invention and as shown more particularly by way of example in FIGS. 1–4 of the accompanying drawings, the seat of the movable point 1 in the cradle 2 of a crossing frog incorporated in long welded rails, said cradle 2 being comprised of two elements, namely, a monoblock element 2' and an element 2'' constituted by two rails 3 and 4 and connected to the monoblock element 2' by welding or by any other type of assembly, is characterized in that the connection between the movable point 1 and the element 2' of the cradle constituted by two rails 3 and 4 is effected by an essentially mechanical assembly.

Figure 2:
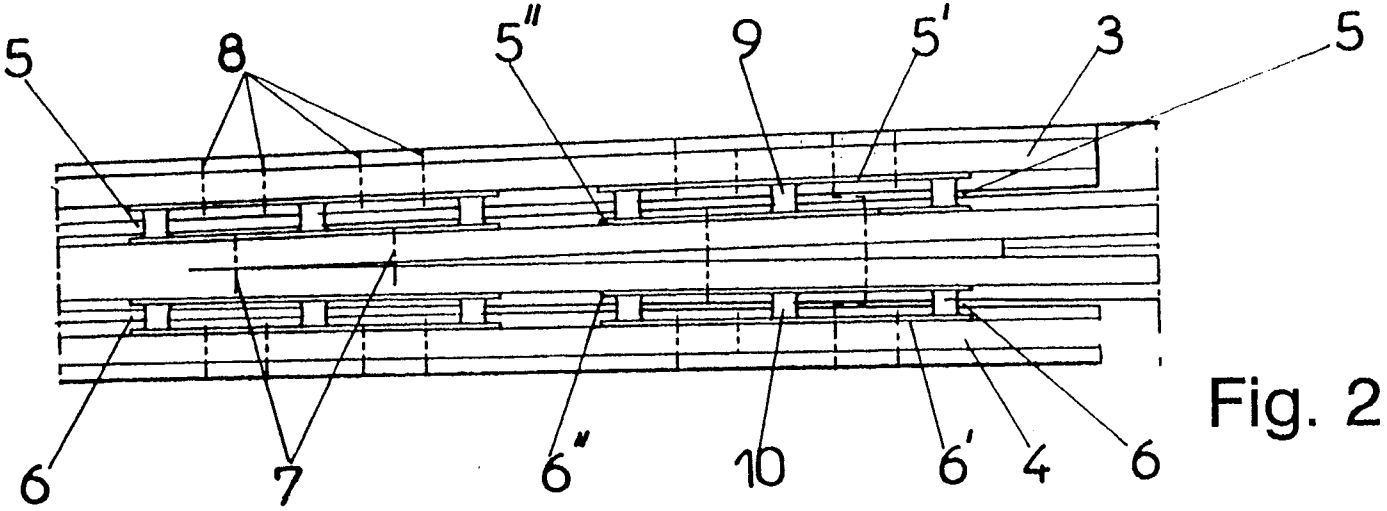
FIG. 2 is a plan view, on a larger scale, of the seating region.
Figure 3:
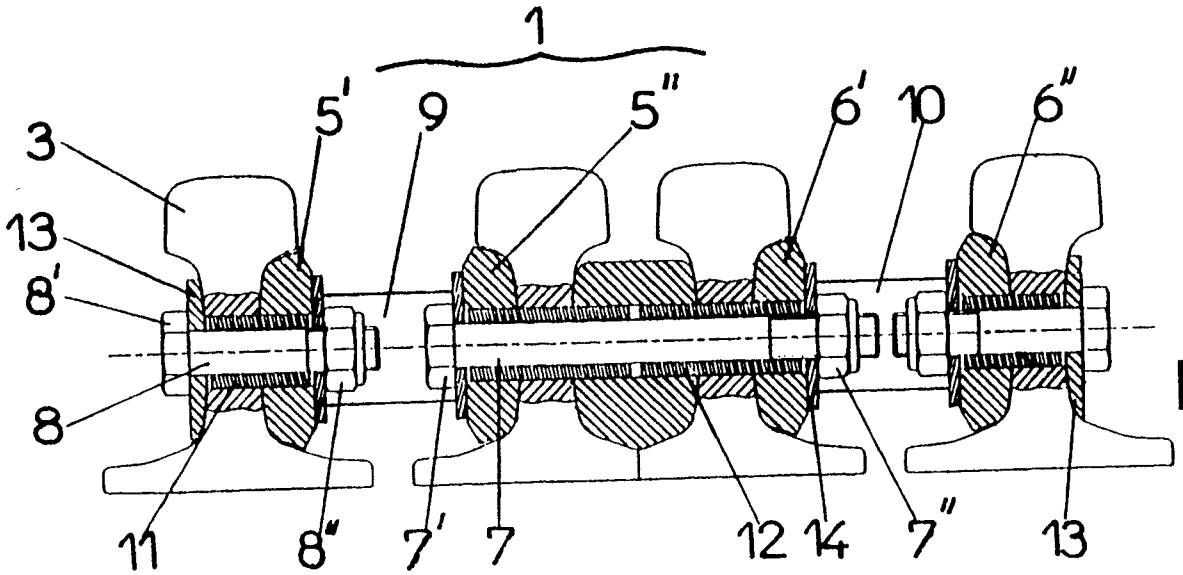
FIG. 3 is a cross sectional view on A—A of FIG. 1.

This is simply preferably effected by means of cross pieces 5 and 6 secured, on the one hand, to the movable point 1 by means of high resistance bolts 7 and, on the other hand, to the rails 3 and 4 of the element 2' of the cradle 2 by means of high resistance bolts 8 (FIG. 2). The cross pieces 5 and 6 are each in the form of a pair of profiles 5', 5'' and 6', 6'' bearing on the base of the web of the rails and providing fish plate bearings because: of the clamping of the high resistance bolts, permitting the obtention of a strong friction web to web, the profiles 5', 5'' and 6', 6'' of each pair being interconnected respectively by means of small bars 9 and 10.

The high resistance bolts 7 and 8 coact as the profiles 5' 5'' and 6', 6'' of the cross pieces 5 and 6 and with the rails 3 and 4 by means of split pins 11 and 12 of spring steel, serving on the one hand as sleeves for said bolts 7 and 8, whose heads 8' bear via members 13 on the external surfaces of the rails 3 and 4 and whose nuts 7'' and 8'', as well as the heads 7' of the bolt 7, bear on the profiles 5', 5'' and 6', 6'' of the cross pieces 5 and 6 via rings 14 and, on the other hand, as shear members for the longitudinal forces, to absorb the longitudinal stresses in case of loss of the friction.

The split pins pass through the rails 3 and 4 and the movable plate 1 by means of holes. As a result, the longitudinal displacements of the rails relative to the crossing frog are extremely limited. Moreover, the longitudinal shear forces are absorbed by the split pins 11 and 12, such that the high resistance bolts 7 and 8 are subjected only to traction.

The cross pieces 5 and 6 transmit by friction, from the point 1 to the cradle 2, an important portion of the tractive force or compressive force engendered by the long welded rails. The rest of these forces is absorbed by the shear resistance of the split pins 11 and 12 of spring steel forming the sleeves of the bolts 5 and 6.

Tests conducted in the laboratory with a safety margin of 1.5 relative to the maximum forces contemplated and with a variation of 45° C. relative to the equilibrium temperature of the long welded rails, show that 80% of the tractive force or the compressive force is absorbed by the friction at the base of the web and 20% by the split pins 11 and 12.

The seat assembly according to the invention is so conceived that in case of loss of friction, the split pins 11 and 12 are capable of absorbing the overall shear force.

The invention also has for its object a process for the production of the seat, characterized in that it comprises a provisional phase of mounting the various elements of the movable point 1 and of the cradle 2 of the crossing frog and a final phase of emplacement of disassemblable mechanical connection means.

Figure 1:
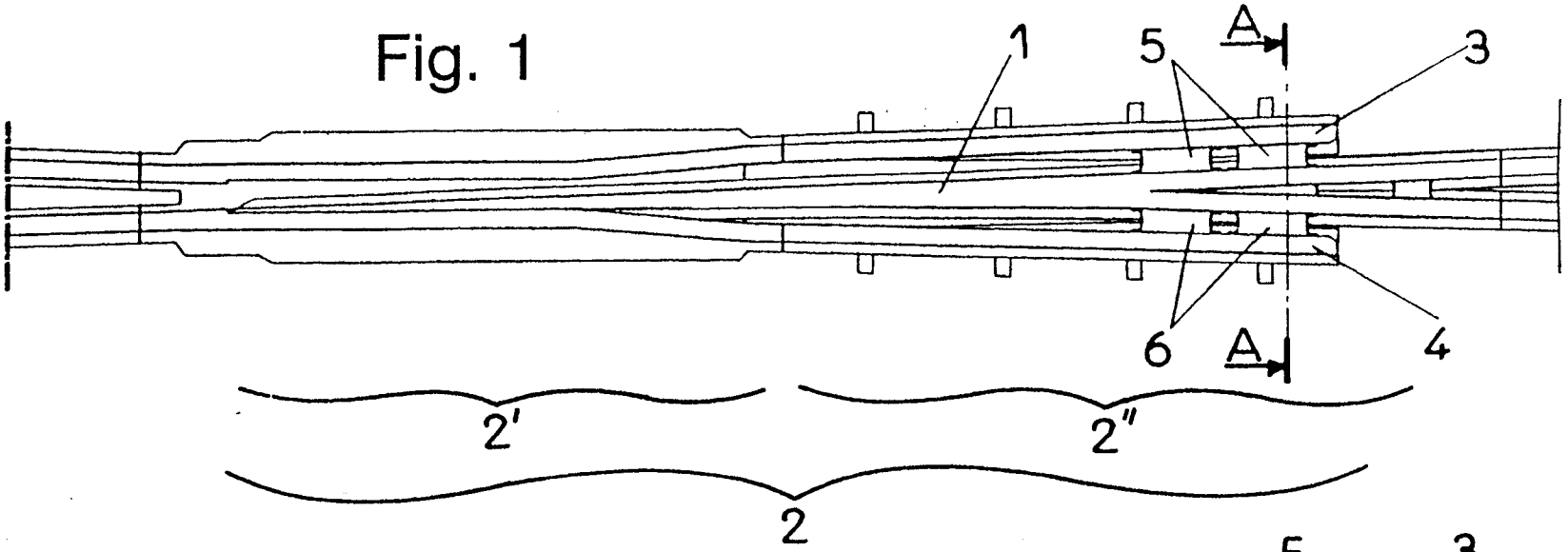
FIG. 1 is a plan view of a crossing frog with a movable point according to the invention.
Figure 4:
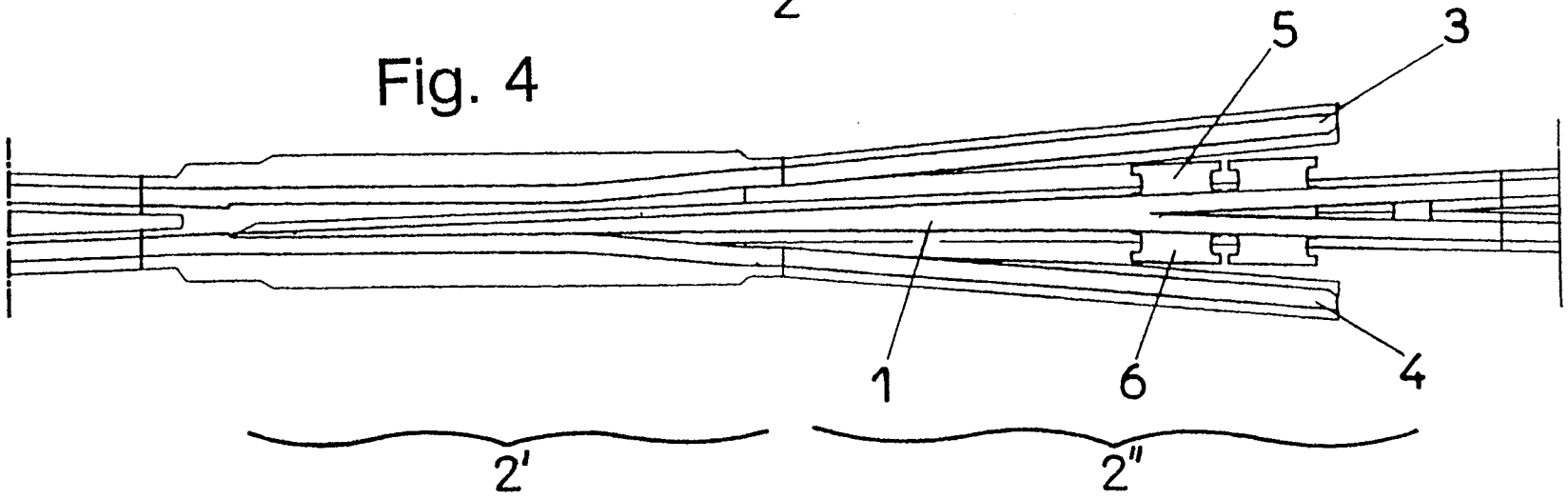
FIG. 4 is a view similar to that of FIG. 1, the two rails of the cradle element being spaced.

In the provisional phase, the process consists in securing the profiles 5' and 6' on the point 1, the profile 5' on the rail 3 and the profile 6' on the rail 4, positioning precisely the point 1 and the rails 3 and 4, introducing the small bars 9 and 10 and connecting them respectively to the profiles 5', 5'' and 6', 6'' by spot welds, then positioning the cross pieces 5, 6 to space apart the rails 3 and 4, as shown in FIG. 4, and finally definitively welding the small bars 9 and 10.

The final phase of the process consists in emplacing the split pins 11 and 12, positioning the cross pieces 5 and 6 and securing them by means of high resistance bolts 7 and 8.

Figure 5:
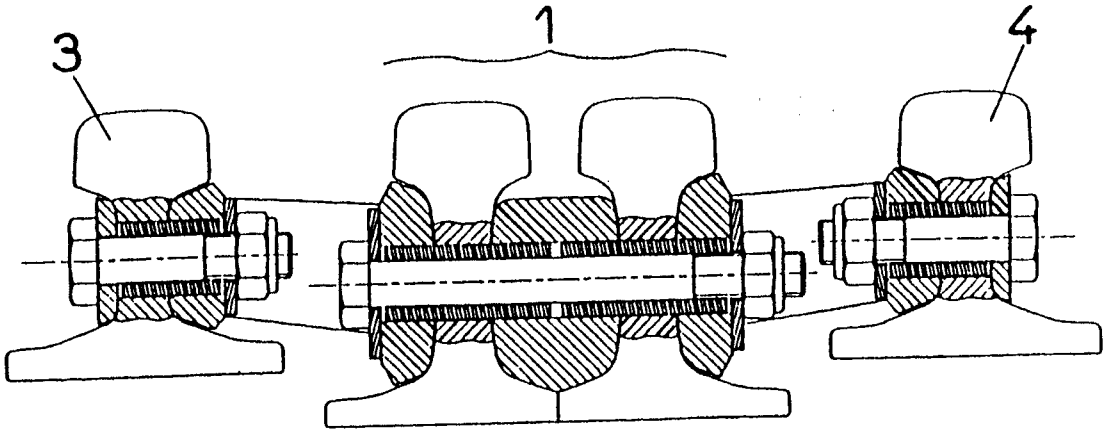
FIGS. 5 and 6 show, in views analogous to that of FIG. 3, modified embodiments of the invention.
Figure 6:
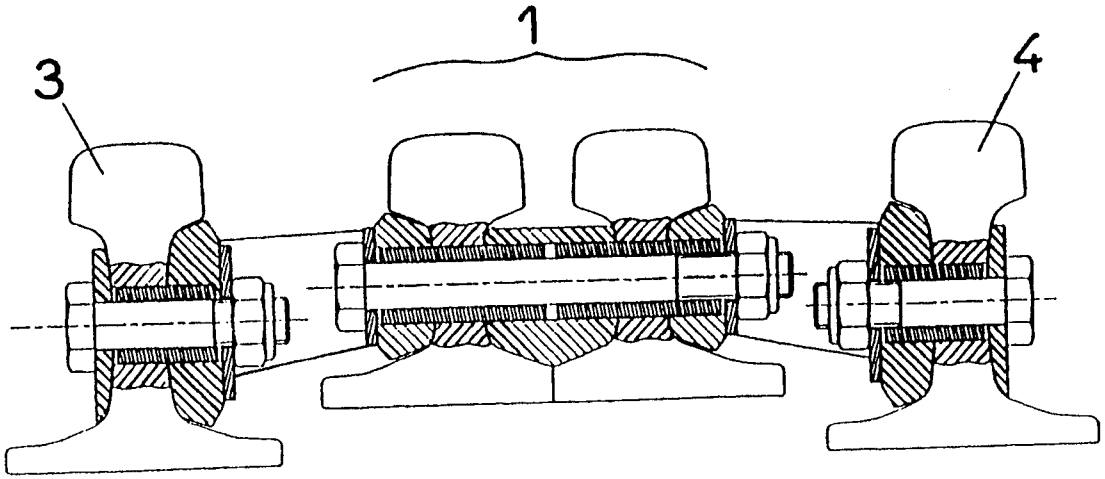

The seat structure according to the invention is applicable to a movable frog point, whose point 1 and rails 3 and 4 are of different height, as shown in FIGS. 5 and 6. Similarly, the invention is applicable to constructions whose point 1 and/or rails 3 and 4 are of asymmetric rail section profile.

Finally, the apparatus according to the invention is also applicable to a crossing frog with a fixed point.

Thanks to the invention, it is possible to provide a seat for the movable point 1 in the cradle 2 of a crossing frog incorporated in long welded rails and subjected to high compression and traction forces engendered by variations of temperature in said long welded rails.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. A seat comprising a movable point (1) in a cradle (2) of a crossing frog incorporated in long welded rails, said cradle (2) being comprised by a monoblock element (2') and two rails (3 and 4) secured to the monoblock element (2'), crosspieces (5 and 6) secured to the movable point (1) by means of bolts (7) and to the rails (3 and 4) by means bolts (8), said crosspieces being in the form of pairs of profiles (5', 5'' and 6', 6'') secured against the rails (3 and 4), the profiles of each pair being interconnected respectively by means of small bars (9 and 10), said bolts being surrounded by sleeves (11 and 12) that pass through said rails (3 and 4) and through said profiles (5', 5'' and 6', 6'').

2. A seat according to claim 1, there being heads (7', 8') and nuts (7'', 8'') on opposite ends of said bolts that retain said sleeves (11 and 12) on said bolts 7) and 8).

3. A seat according to claim 1, wherein said sleeves are split sleeves of spring steel.

4. A process for the production of a seat for a movable point (1) in a cradle (2) of a crossing frog incorporated in long welded rails, said cradle (2) being comprised by a monoblock element (2') and two rails (3 and 4) secured to the monoblock element (2'), crosspieces (5 and 6) secured the movable point (1) by means of bolts (7) and to the rails (3 and 4) by means of bolts (8), said crosspieces being in the form of pairs of profiles (5', 5'' and 6', 6'') secured against the rails (3 and 4), the profiles of each pair being interconnected respectively by means of small bars (9 and 10), said bolts being surrounded by sleeves (11 and 12) that pass through said rails (3 and 4) and through said profiles (5', 5'' and 6', 6''), the process comprising securing said profiles to said point and to said rails, positioning with precision said point and rails relative to each other, connecting said small bars between said profiles by spot welding, positioning said crosspieces to space the rails, further welding said small bars to said profiles, and securing said profiles to said point and said rails by means of said bolts, and surrounding said bolts with said sleeves that extend through said profiles and said point and said rails

5. A process according to claim 4, wherein said sleeves are split sleeves of spring steel.

* * * * *